US006669656B2

(12) United States Patent
Tsai

(10) Patent No.: US 6,669,656 B2
(45) Date of Patent: Dec. 30, 2003

(54) TROUSER-TYPE MASSAGER

(76) Inventor: Sam Tsai, 4F, No. 14, Lane 281, Sec. 2, Hsi Yuan Road, Taipei (TW)

( * ) Notice: Subject to any disclaimer, the term of this patent is extended or adjusted under 35 U.S.C. 154(b) by 0 days.

(21) Appl. No.: 10/134,486

(22) Filed: Apr. 30, 2002

(65) Prior Publication Data

US 2003/0204152 A1 Oct. 30, 2003

(51) Int. Cl.[7] ..... A61H 1/00
(52) U.S. Cl. ..... 601/46; 601/15
(58) Field of Search ..... 601/1, 15, 21, 601/46, 67, 69–71, 78, 79, 68; 2/227, 228

(56) References Cited

U.S. PATENT DOCUMENTS 5,235,967 A * 8/1993 Arbisi et al. ..... 601/101
5,950,239 A * 9/1999 Lopez ..... 2/115
6,065,154 A * 5/2000 Hulings et al. ..... 2/102
6,193,678 B1 * 2/2001 Brannon ..... 601/15
6,460,195 B2 * 10/2002 Wang ..... 2/228

* cited by examiner

*Primary Examiner*—Justine R. Yu
(74) *Attorney, Agent, or Firm*—Browdy and Neimark, P.L.L.C.

(57) ABSTRACT

A trouser-type massager mainly comprises a trouser architecture, a plurality of low-frequency wave generators and flexible massage pads, and a conductive cord. In the trouser architecture, a plurality of flexible massage pads is mounted to surround a user's thighs and buttocks. Through the conductive cord buried in a trouser seam, the low-frequency generators can be connected with the circuits of the flexible massage pads so as to create waves to massage human body via the silicon film of the massage pads.

3 Claims, 7 Drawing Sheets

TROUSER-TYPE MASSAGER

FIELD OF THE INVENTION

This invention relates to a trouser-type massager having increased body massage zones for massage at low frequencies.

BACKGROUND OF THE INVENTION

As shown in FIG. 1, a low-frequency massager usually comprises a plurality of separate sticky electrode sticking pieces 31 to be attached directly onto human skin and a low-frequency wave generator disposed in a host machine 33. Several indication lamps, selection keys, and adjustment knobs in electrically conductive connection with the low-frequency wave generator are arranged on a housing panel of the host machine 33 for controlling waveform, amplitude, or frequency of the wave generated from the host 33. On the housing panel of the host 33, there is also provided with a plurality of jackets for reception of terminals of the electrode sticking pieces 31 such that a user might attach those electrode sticking pieces on his skin separately to where he sees fit, then connect them with the host 33 via an electrically conductive cord 32 for massage of acupoints.

The low-frequency massager with separate electrode sticking pieces is considered defective in the following respects:

1. Disposition of the electrode sticking pieces and massage zones are limited. Also, the amount of required electrode sticking piece is considerable because of its small size.

2. Too many intricate accessories make it difficult for use. In using this massager every time, a user has to connect each electrode sticking piece with the host machine.

3. The attached electrode sticking pieces might make a user who has sensitive skin uncomfortable.

In another low-frequency massager shown in FIG. 2, a flexible massage pad 1 has an inner side 11 for attachment to human skin composed of at least two pieces of disconnected electrically conductive nonsticky silicon film 13 and an outer side 12 composed of soft rubberized unconductive fabric 14. The flexible massage pad 1 has a Velcro fastener 18, 19 arranged at each of two sides thereof, and a plurality of metallic push-button convex surfaces 15 is disposed on the silicon film 13. A plastic adhesive label 3 is attached on the backside 17 of each convex surface of push button 15 and a silicon film 16 is adhered on each adhesive label 3 for sticking the backside 17 of the convex surface of push button 15. Moreover, a recess (not shown) is formed on the backside of a wave adjuster 2 for retaining the same on the flexible massage pad 1. Such a massager though has saved the breath of complicated wiring connection and allowed a user to move his body for reading, etc., it is advisably employed for some specified parts, such as the extremities or the waist, due to the rectangular piece formation of the massager.

This invention is proposed to provide a trouser-type massager composed of a trouser architecture, a low-frequency wave generator, a flexible massage pad, and circuitry wiring. The trouser architecture is made of a well perspiratory material and the massage pad is separately distributed to the upper portion of the thighs and the upper/lower portion of the buttocks for massage purpose. The inner face of the flexible massage pad is formed by nonsticky conductive silicon film and the low-frequency generator is equipped with a voltage-adjustment knob, a mode switch, a cell receptacle, and several pilot lamps.

The massager of this invention is characterized in: generating low-frequency waves to massage human body through the flexible pad by making use of a conductive cord concealed in a seam of trouser architecture to thereby trigger the low-frequency wave generator, and this massager has been improved to waive extra conductive wiring, untie body bondage, lessen skin sensitivity, and increase massage zones meanwhile.

SUMMARY OF THE INVENTION

The primary objective of this invention is to provide a trouser-type massager based on a trouser architecture having a plurality of male copper buttons in connection with several low-frequency wave generators via a conductive cord and a plurality of female copper buttons in connection with flexible massage pads, in which the inner surface of each flexible massage pad facing human skin is made in form of nonsticky conductive silicon film; and by taking advantage of a varnished wire, the low-frequency wave generators and the flexible massage pads can be connected to massage the thighs and buttocks of a wearer of this invention.

Another objective of this invention is to provide a trouser-type massager based on a trouser architecture having a plurality of male copper buttons buckled with conductive metallic push-buttons on back of low-frequency wave generators equipped with a voltage adjustment knob, a mode switch, a cell receptacle, and several pilot lamps such that the massager of this invention can massage human body directly without intricate wire connection and electrode sticking pieces by making use of the waves created from the low-frequency wave generators.

Yet another objective of this invention is to provide a trouser-type massager, in which a retaining device of Velcro fastener fitting people in different sizes is arranged at the waistline of a trouser architecture and an outer surface of the thighs for tightening flexible massage pads on skin for achieving fitness purpose.

In order to realize above said objectives, the trouser-type massager of this invention mainly comprises a trouser architecture, a plurality of low-frequency wave generators and flexible massage pads, and a conductive cord. In the trouser architecture, a plurality of flexible massage pads is mounted on the thighs and surrounding the buttocks. Through the conductive cord buried in a trouser seam, the low-frequency generators can be connected with the circuits of the flexible massage pads so as to create waves to massage human body via the silicon film of the pads.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
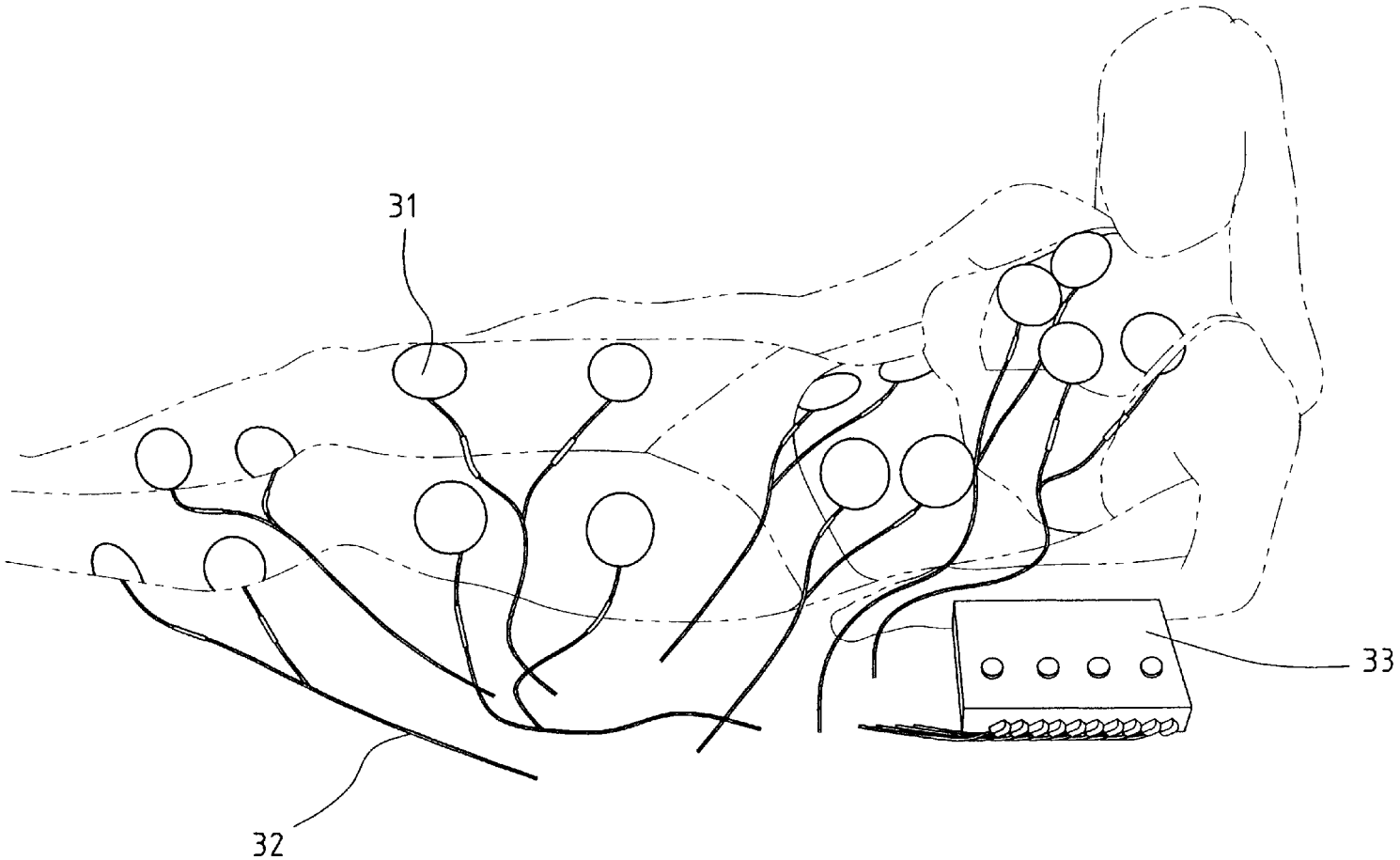
FIG. 1 (PRIOR ART)
FIG. 1 is a schematic view of a conventional low-frequency massager showing the configuration of a plurality of electrode sticking pieces.
Figure 2:
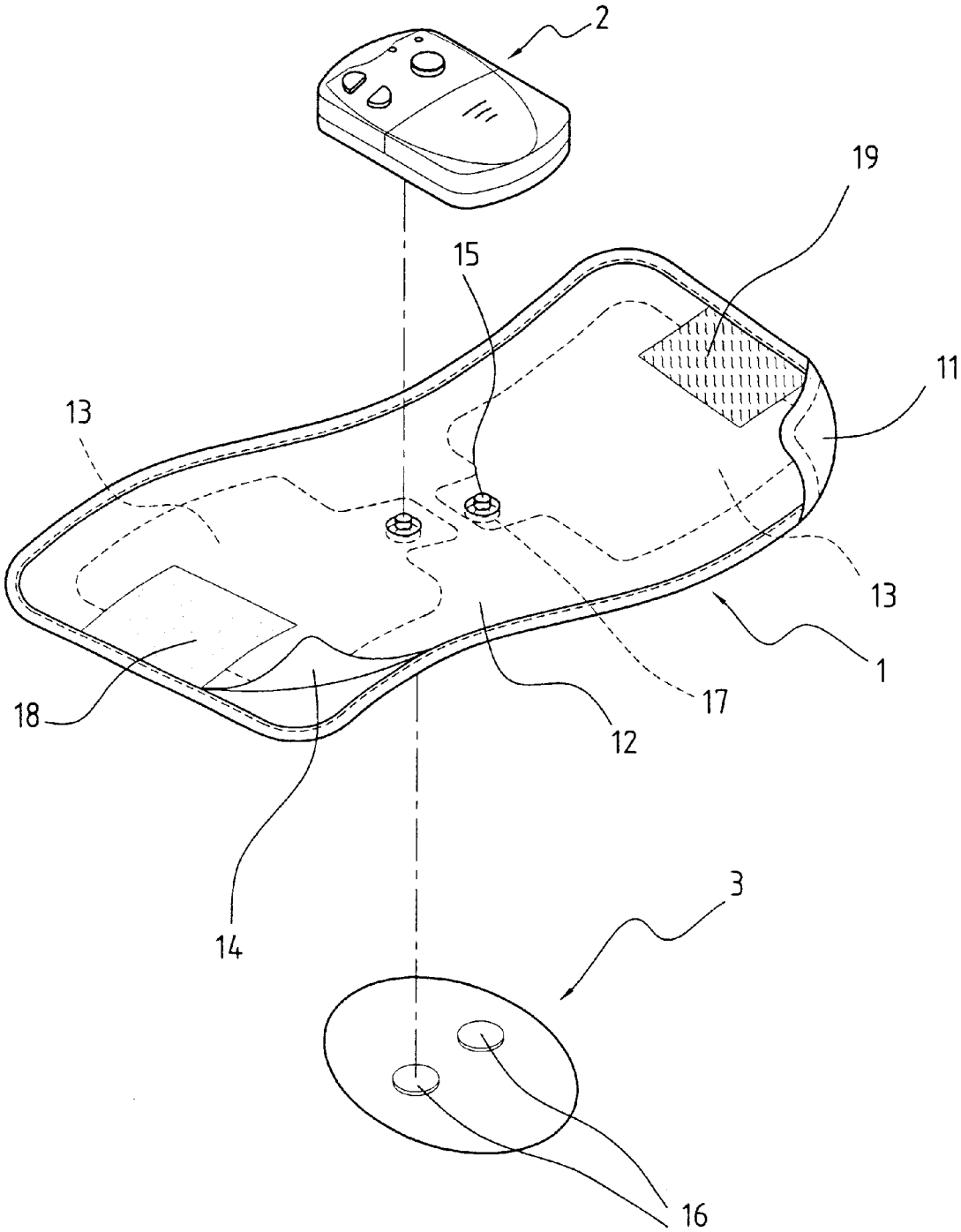
FIG. 2 (PRIOR ART)
FIG. 2 is a schematic view of another conventional massager.
Figure 3:
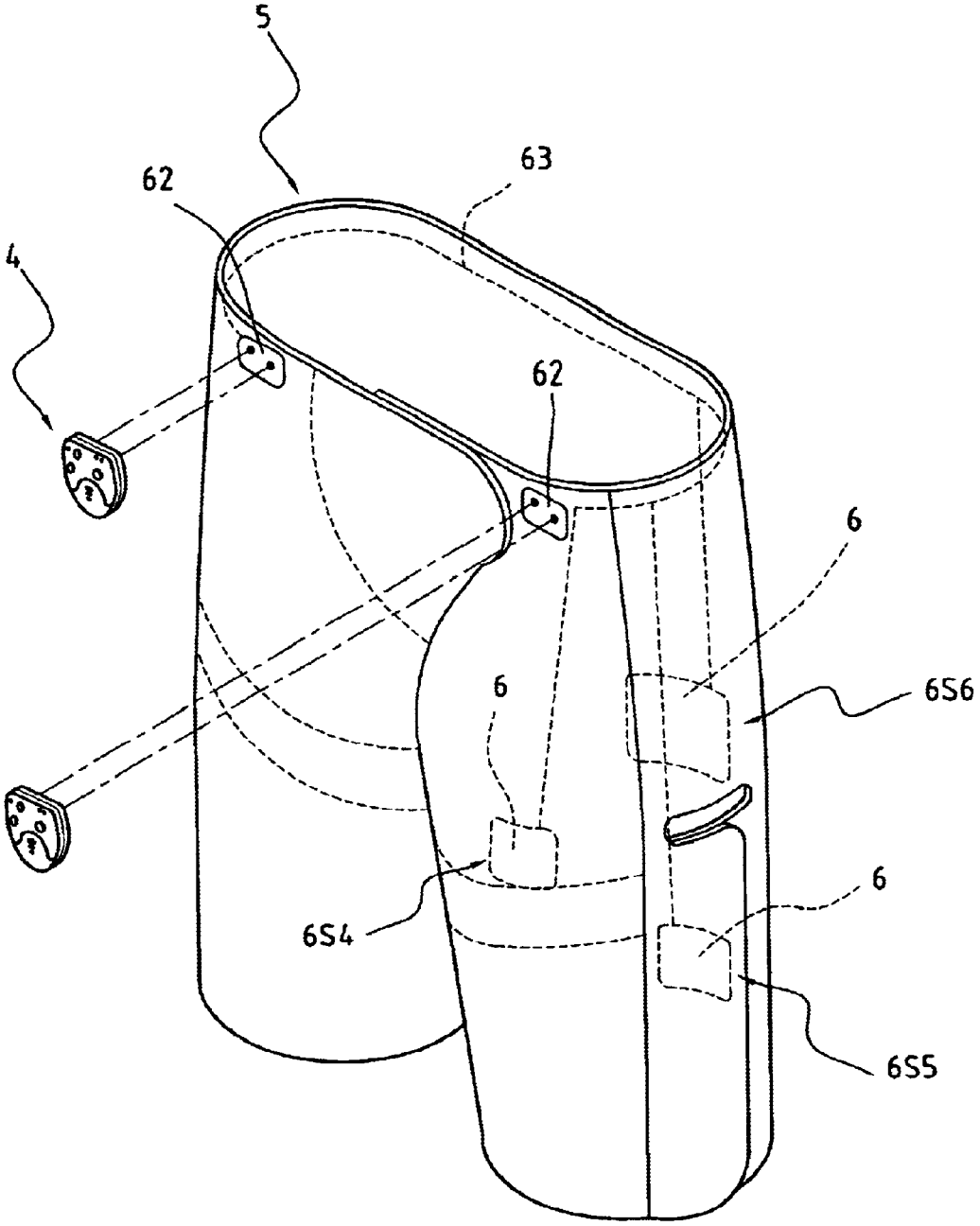
FIG. 3 is a perspective view of this invention.
Figure 4:
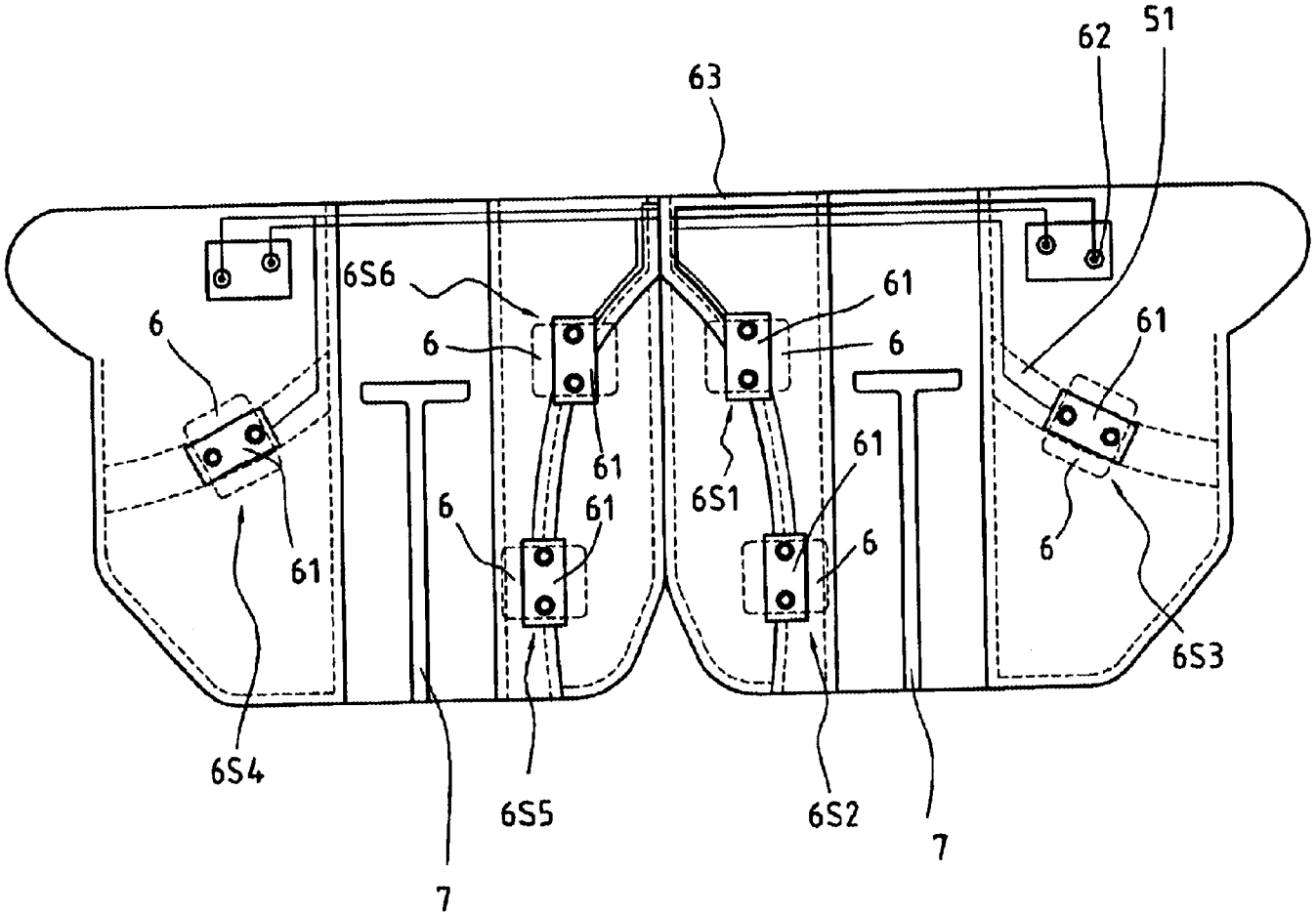
FIG. 4 is a plan view of this invention.
Figure 5:
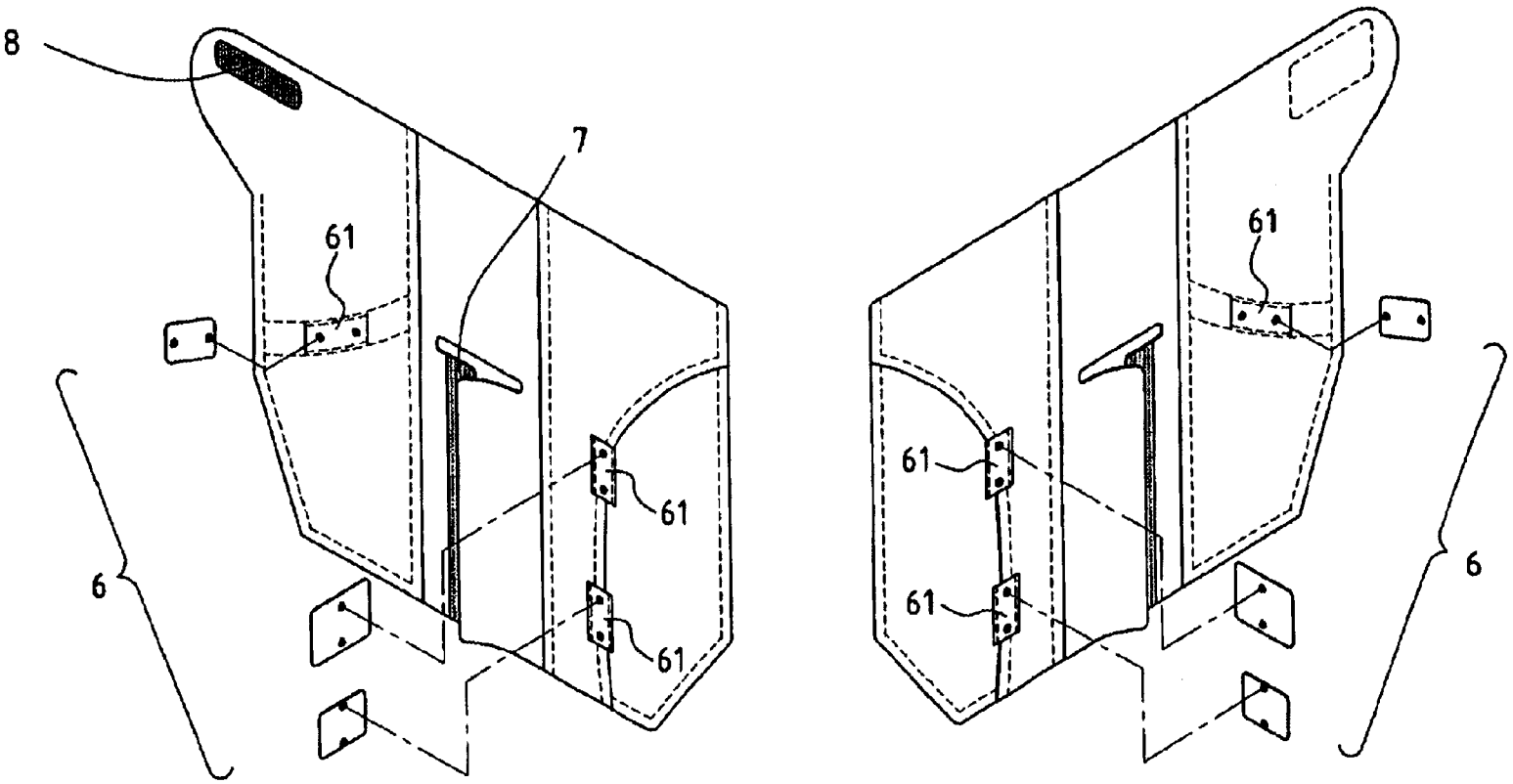
FIG. 5 is an exploded view of this invention.
Figure 6:
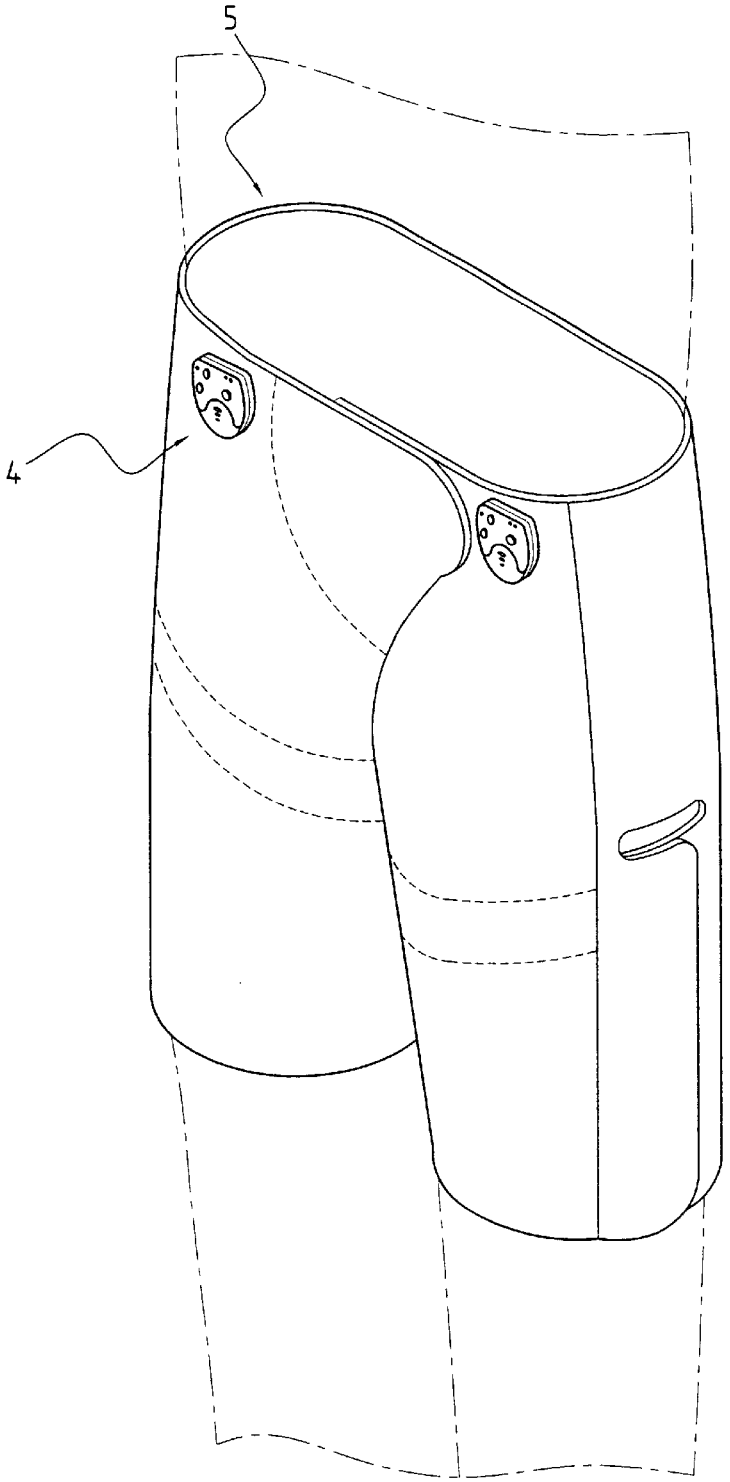
FIG. 6 shows an embodiment of this invention.
Figure 7:
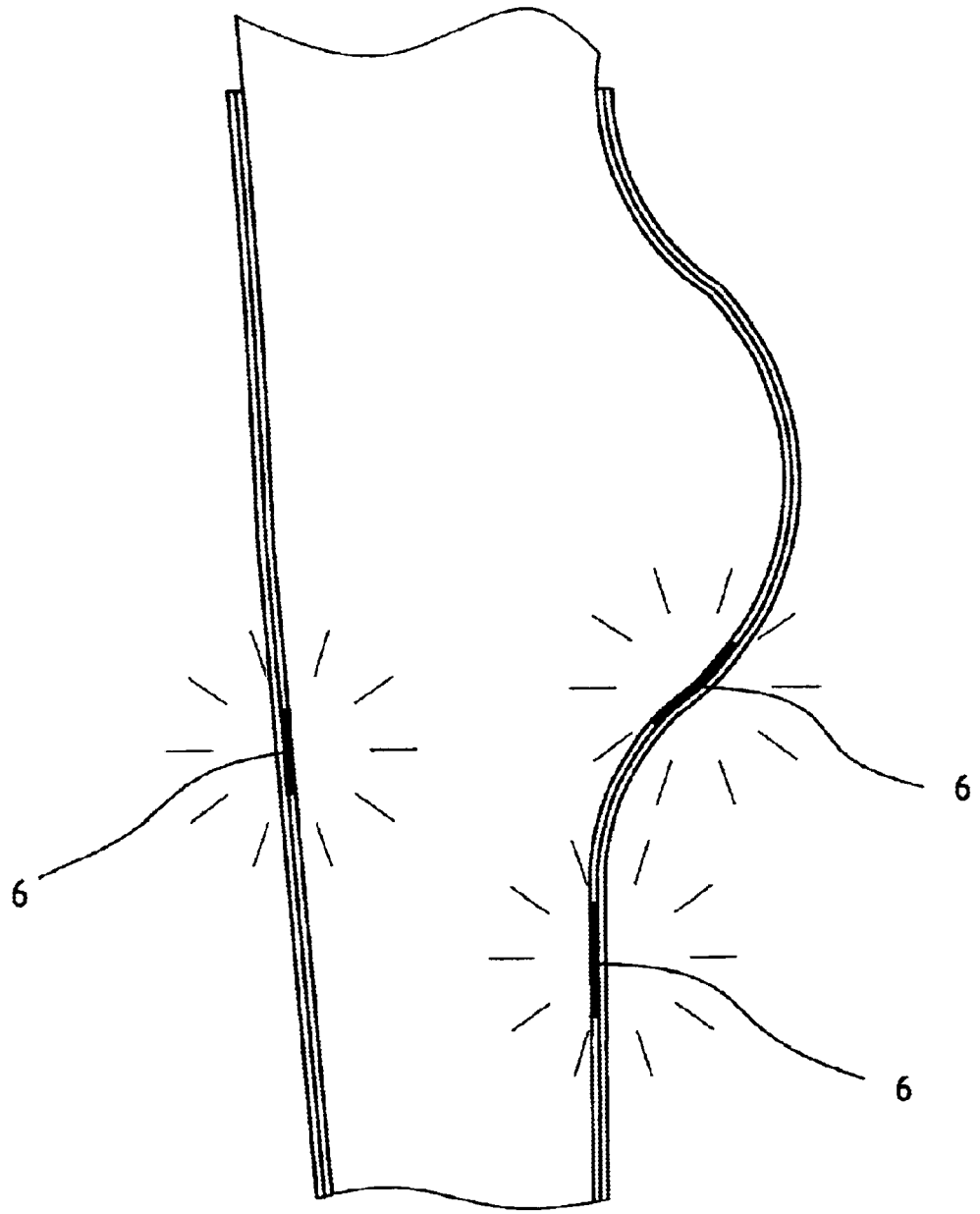
FIG. 7 shows a lateral view of this invention.

As shown in FIG. 3, a trouser-type massager of this invention mainly comprises a trouser architecture 5, a plurality of low-frequency wave generators 4 and flexible massage pads 6, and a conductive cord 63, in which the trouser architecture 5 is constructed with a perspiratory and permeable material; and the wave generators 4 are disposed on respective sides of the trouser architecture 5 about the waistline for control of the massage pads 6 of which the inner surface is formed by nonsticky conductive silicon film and is distributed to somewhere adjacent to a front portion of the thighs and an upper/lower portion of the buttocks for massage purpose.

Referring this time to FIGS. 4 through 7, the conductive cord 63 is a varnished wire buried in a trouser seam 51. A male copper button 62 is located on respective sides of the waistline of the trouser architecture 5 while a plurality of female copper buttons 61 is disposed on a front portion of the thighs and an upper/lower portion of the buttocks for buckling with metallic buttons on the massage pads 6. The conductive cord 63 is connected in the manner that the female copper button 61 in zone **6*s*3 forms a parallel circuit with the female copper button 61 in zone 6*s*4; the female copper button 61 in zone 6*s*2 forms a parallel circuit with the female copper button 61 in zone 6*s*5; the female copper button 61 in zone 6*s*1 is electrically connected with the male copper button 62 in a zone on the same side; and the female copper button 61 in zone 6*s*6 is electrically connected with the male copper button 62 in a zone on the same side. In such a way of connection, the conductive cord 63** would encircle a closed circuit.

To use the massager of this invention, a user is supposed to open a front Velcro fastener 8, and before wearing this massager, buckle the flexible massage pads 6 to the female copper button 61 located in zones **6*s*1, 6*s*2, 6*s*3, 6*s*4, 6*s*5, 6*s*6, and finally adjust a Velcro fastener 7 on the outer portion of the thighs to tighten the attachment of this invention such that the front portion of the thighs and the upper/lower portion of the buttocks of the user can be fully massaged after the low-frequency wave generators 4** have been actuated.

In the above described, at least one preferred embodiment has been described in detail with reference to the drawings annexed, and it is apparent that numerous variations or modifications may be made without departing from the true spirit and scope thereof as set forth in the claims below.

What is claimed is:

1. A trouser-type massager, which can massage a user's thighs and buttocks by making use of a low-frequency wave generator disposed at a top end of trousers, comprising:

a trouser architecture having a plurality of male and female copper buttons;

a low-frequency wave generator having a plurality of conductive metallic buttons for buckling with said male copper buttons on said trouser architecture; and a flexible massage pad, of which the inner face near skin is made in form of a nonsticky conductive silicon film, and on which a plurality of conductive metallic push-buttons is provided corresponding to said female copper buttons;

in which a conductive cord is buried in a trouser seam of said trouser architecture to connect with said flexible massage pad and said low-frequency wave generator such that the waves generated from said generator can be transmitted to the silicon film of said flexible massage pad to achieve massage purpose.

2. The trouser-type massager according to claim 1, in which said conductive cord is a varnished wire.

3. The trouser-type massager according to claim 1, in which said conductive cord is connected in a manner that a female copper button in a first zone (**6*s*3) forms a parallel circuit with said female copper button in a second zone (6*s*4); a female with a female copper button in a fourth zone (6*s*5); a female copper button in a fifth zone (6*s*1) is electrically connected with a male copper button in a zone on the first side of the trouser architecture; and a female copper button in a sixth zone (6*s*6**) is electrically connected with a male copper button in a zone on a second side of the trouser architecture so that said conductive cord encircles a closed circuit.

* * * * *